US007341306B1

(12) United States Patent
Neese et al.

(10) Patent No.: US 7,341,306 B1
(45) Date of Patent: Mar. 11, 2008

(54) CONVERTIBLE SEAT ASSEMBLY

(75) Inventors: David A. Neese, Winterville, NC (US); Darwyn T. Faulds, Jr., Mount Pleasant, SC (US)

(73) Assignee: Grady-White Boats, Inc., Greenville, NC (US)

( * ) Notice: Subject to any disclaimer, the term of this patent is extended or adjusted under 35 U.S.C. 154(b) by 0 days.

(21) Appl. No.: 11/644,113

(22) Filed: Dec. 22, 2006

(51) Int. Cl.
*A47C 13/00* (2006.01)
*A47C 7/62* (2006.01)
*A47C 15/00* (2006.01)

(52) U.S. Cl. ..... 297/105; 297/188.1; 297/244; 297/118

(58) Field of Classification Search ..... 297/118, 297/105, 111, 188.1, 244, 257, 284.11
See application file for complete search history.

(56) References Cited

U.S. PATENT DOCUMENTS 2,971,568 A 2/1961 Rorie et al.
2,993,529 A * 7/1961 Brown ..... 297/65
3,379,471 A 4/1968 Dalziel
3,379,472 A * 4/1968 Hilfiker ..... 297/118
3,394,417 A * 7/1968 O'Link ..... 114/363
4,292,697 A * 10/1981 Alembik ..... 5/18.1
4,544,199 A * 10/1985 Wrigley ..... 297/244
4,799,632 A * 1/1989 Baymak et al. ..... 244/122 R
5,799,605 A 9/1998 Huse
5,902,009 A * 5/1999 Singh et al. ..... 297/188.1

* cited by examiner

*Primary Examiner*—Milton Nelson, Jr.
(74) *Attorney, Agent, or Firm*—Olive & Olive, P.A.

(57) ABSTRACT

A seating assembly is made up of both fixed and positionable components. The assembly in a first position provides in a back-to-back relation respectively oppositely facing seats. In a second position the assembly provides a substantially horizontal lounge a portion of which is withdrawn from a stored position below the seats. The lounge when withdrawn includes the sitting surface portion of a selected one of the oppositely facing seats as part of the lounge and when stored utilizes such sitting surface portion as part of the selected seat.

11 Claims, 2 Drawing Sheets

CONVERTIBLE SEAT ASSEMBLY

DESCRIPTION

The construction of the invention is made up of components, which can be arranged either as a back-to-back seat configuration or as a configuration providing both a fixed seat and a lounge. Application to use on a recreational boat is used by way of example. The word "lounge" is used here to mean, in general, a seat construction having a leg rest as well as a backrest.

The invention construction provides means for converting one of a pair of back-to-back seats to a lounge seat without eliminating an opposing fixed seat. More specifically, the construction of the invention provides a back to back seat assembly one side of which comprises a fixed seat facing in one direction, typically forward, and the other side of which comprises a fixed back rest facing in an opposite direction, typically rearward, and in operative association with the fixed back rest a lounge member which can be positioned in a first position to serve as a lounge or in a second position to serve as a sitting surface for the rearwardly facing fixed back rest. In the first position the lounge member is fully withdrawn from a hollow base which supports the back-to-back seats. In the second position part of the lounge member is stored in the bottom base and the remainder is used to provide a sitting surface for the rearwardly facing fixed backrest all of which gives the seat construction of the invention many advantages. For example (but without limitation), when the invention is used in a boat and positioned with the fixed seat beside the driver of the boat, the inventive seat permits one passenger to serve in a look-out capacity and watch for hazards such as debris, people in the water, or boats, while another passenger can enjoy the convenience and flexibility provided by the opposite-facing seat.

The present invention may also be described as providing an assembly having a fixedly positioned hollow base structure and an elongated lounge member mounted on a support. The lounge member and support are adapted to move together back and forth within the hollow base structure. An outer end of the top surface of the lounge member can be positioned to serve as a portion of the lounge member's top surface when the lounge member is withdrawn from the base structure and to serve as a seat surface when the lounge member is substantially fully inserted into the base structure. It is to be noted that substantially the entire top surface of the lounge member serves as a lounge surface and leg rest when the lounge member is fully withdrawn from the base structure. The assembly further includes a pair of fixedly positioned back rests facing, back to back, in respective forward and rearward directions and adjacent the lower edge of the forward facing one of which resides a second fixed seat surface elevated above the level of said first seat surface. Provision is made for the support structure, which supports and moves with the lounge member back and forth in the hollow base structure to server as a receptacle accessible through a liftable lid, e.g. the lounge member.

The invention assembly when in use, can, as previously mentioned, be arranged in one configuration in which the lounge member is substantially fully inserted in the hollow base structure and creates a pair of back to back seats facing the respective rearward and forward directions mentioned above. Since application to a recreational boat is used by way of example, reference to a "back to back" orientation assumes that the back rests of the seats face in opposite directions whatever those directions might be, assuming, by way of example, that one seat faces forward and the other seat faces rearward with reference to the path of the boat. In another configuration, in which the lounge member is substantially fully moved outwardly from the hollow base, a lounge surface is created on one side of the assembly without disturbing either of the fixed back rests or the forward facing fixed seat being used by way of example.

Figure 1:
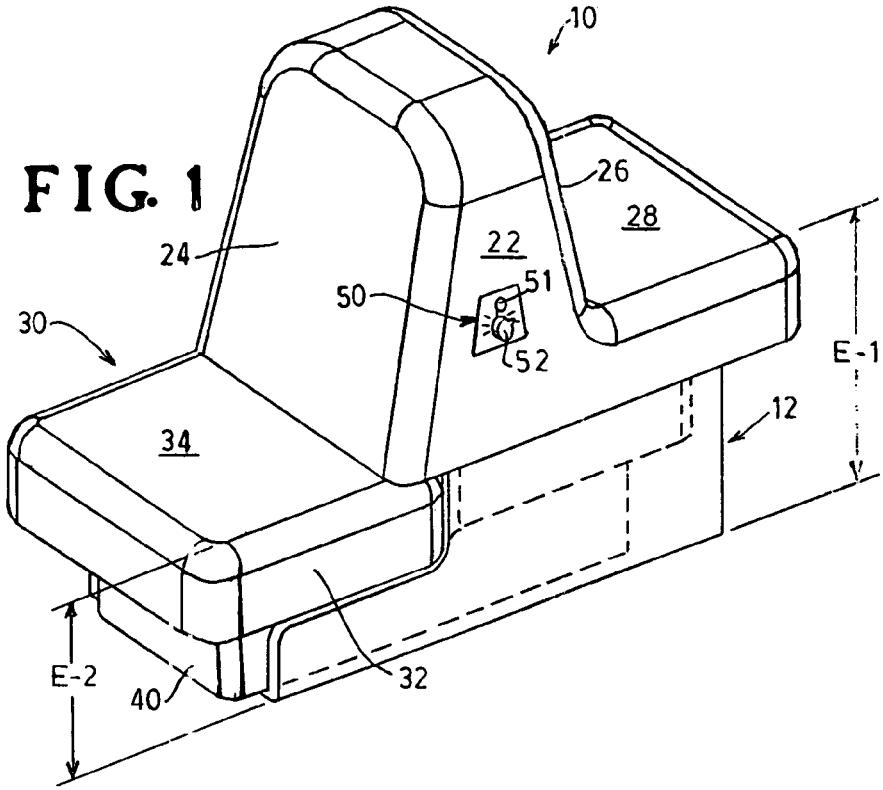
FIG. 1 is a perspective view of the assembly of the invention with the lounge support structure substantially fully inserted and in a back-to-back seating configuration.

Referring to the drawings, the seating assembly 10 of the invention comprises a hollow base 12 made up of opposed side walls, only one of which is shown, bottom wall 18, and end wall 20. Base 12 supports a seat structure 22 preferably of a unitary construction having a pair of inclined but oppositely directed fixedly positioned back rests 24 and 26, and a fixedly positioned seating surface 28. While not shown in detail, it should be understood that backrests 24, 26 and seating surfaces 28, 34 may be uncushioned as shown, or suitably cushioned and appropriately mounted.

From the description given, it should also be understood that hollow base 12 and seat structure 22 including the mentioned back rests 24, 26 and seating surface 28 make up an integral component of the seating assembly 10 of the invention, in which the back rests 24, 26 are fixed, i.e., non-positionable relative to the seating surface 28.

The other major and positionable component of the invention assembly 10 of the invention comprises the positionable lounge component 30. Component 30 is made-up of lounge base 32 the outer end top surface portion 34 of which is, for reference, shown as having a length L-2. The inner top surface portion 36 of lounge base 32 is also shown for reference as having a length L-1. As part of component 30, lounge base 32 in the illustrated embodiment is supported on and detachably attached to a rigid support, illustrated by way of example as a rigid container 40, covered by lounge base 32 and which provides the indicated storage space 44. As will be readily understood by those skilled in the art, lounge member 30 should preferably be formed of an appropriately supported soft, cushion like, compressible material suited, when withdrawn from base 12, for supporting the legs of a person who is resting against backrest 24 as well as, when inserted into base 12, for conforming to the hollow space provided in base 12.

Figure 2:
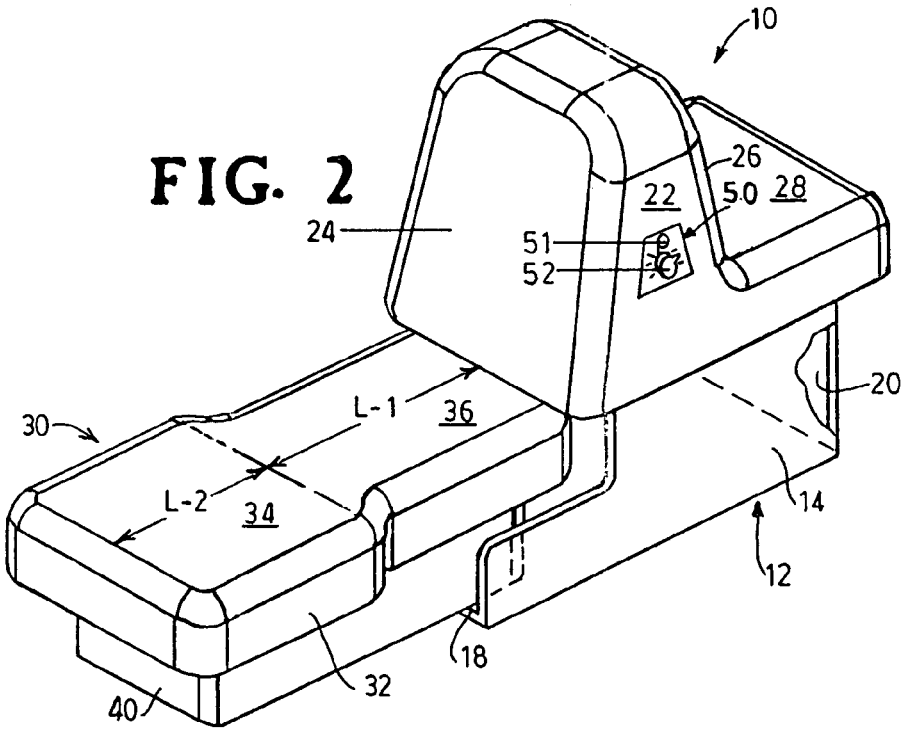
FIG. 2 is a perspective view of the assembly of the invention with the lounge support structure substantially fully withdrawn and in a lounge configuration.
Figure 3:
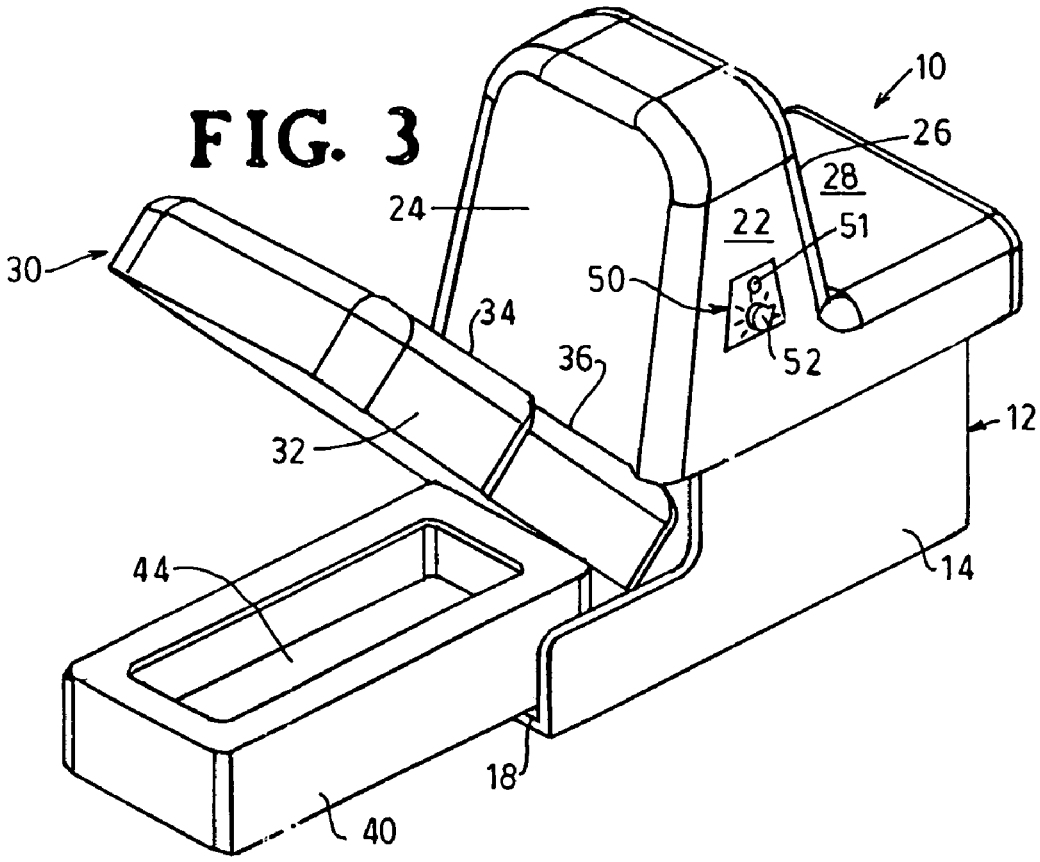
FIG. 3 is a perspective view of the assembly of the invention with the lounge member lifted and the interior of the lounge member support exposed, for purposes of illustration, to show its receptacle.

In use, as best seen in FIG. 1, when the forward end and top surface portion 36 of lounge component 30 is substantially fully inserted in the hollow base 12, the seating surface 34 of lounge component 30, as part of a back to back seat configuration, provides seating for the back rest 24 whereas when lounge component 30 is pulled outwardly from hollow base 12, as in FIG. 2, seating surface 34 becomes part of an overall lounge-single seat configuration as in FIG. 2 and with access to the storage area 44 as in FIG. 3. Also to be recognized here is that storage of lounge component 30 in the hollow space of hollow base 12 is facilitated by providing for the seating surface 28 to be at an appropriate higher elevation E-1 than the elevation E-2 of seating surface 34. The difference in height will of course vary with the application, size of boat, and the like and the amount of hollow space needed to accommodate the lounge component 30 when it is fully inserted into base 12.

While especially intended for use on a recreational boat it is recognized that other uses for the convertible seat assembly of the invention will be found, for example, in mobile homes, campers, lawn furniture and the like.

Further, while not shown in detail, it is recognized that the operation of withdrawing and inserting the lounge component 30 out of an into hollow base 12 could be done electrically, hydraulically or pneumatically as well as manually. Therefore, the appropriate seat or remotely mounted electrical, hydraulic or pneumatic drive and control system 50, including an appropriate on/off switch 51, valve or the like, an appropriate electrical, hydraulic or pneumatic speed control 52, as indicated in the drawings is meant to teach those skilled in the art how movement of the lounge assembly could be done electrically, hydraulically or pneumatically.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A seat assembly made up of both fixed and positionable components and adapted in a first position to provide in a back-to-back relation respective forward and rearward direction facing seats, and in a second position to provide a substantially horizontal lounge which includes a sitting surface portion of said rearward direction facing seat, said assembly comprising:

(a) a fixed component providing:

(i) said forward direction facing seat;

(ii) a back rest portion of said rearward direction facing seat; and (iii) a hollow base structure operative to support said forward direction facing seat and said back rest portion of said rearward direction facing seat; and (b) a moveable component providing:

(i) a lounge;

(ii) a support structure on which said lounge rests; and (iii) means adapting said lounge and support structure to be stored within said hollow base structure and when so stored to utilize an outer portion of said lounge as a sitting surface for said rearward direction facing seat and when withdrawn from said hollow base structure to utilize said outer portion as part of said lounge.

2. A seat assembly as claimed in claim 1 wherein said lounge support structure is adapted to serve as a storage receptacle.

3. A seat assembly as claimed in claim 1 wherein the sitting surface portion of said rearward direction facing seat is formed so as to reside at a lower level than that at which the level of the sitting surface of said forward direction facing seat is formed.

4. A seat assembly as claimed in claim 1 wherein movement of said moveable component is facilitated by drive means selected from electrical, hydraulic or pneumatic drive means.

5. A seat assembly made up of both fixed and positionable components and adapted in a first position to provide in a back-to-back relation respective oppositely first and second direction facing seats and in a second position to provide a substantially horizontal lounge, said assembly comprising:

(a) a fixed component providing:

(i) said first direction facing seat;

(ii) a back rest portion of said second direction facing seat; and (iii) a hollow base structure operative to support said first direction facing seat and said back rest portion of said second direction facing seat; and (b) a moveable component providing:

(i) a lounge; and (ii) means adapting a portion of said lounge to be stored within said hollow base structure when not in use as a lounge and to be withdrawn from said hollow base structure when in use as a lounge.

6. A seat assembly as claimed in claim 5 wherein said means adapting a portion of said lounge to be stored when not in use as a lounge also permits a portion of said lounge when not in use as a lounge to serve as a sitting surface for said direction facing seat.

7. A seat assembly, comprising:

(a) a first seat, having a fixed back rest and a fixed sitting surface;

(b) a second seat having a fixed back rest and a positionable sitting surface;

(c) said back rests of both said seats together with said fixed sitting surface of said first seat being formed as a unitary structure;

(d) a hollow base structure supporting said unitary structure; and (e) a lounge member having a top surface which includes said positionable sitting surface of said second seat and being positionable with respect to said hollow base structure to expand and contract a portion of said top surface of said lounge member.

8. The seat assembly of claim 7 wherein said lounge member is adapted to serve as a storage receptacle.

9. The seat assembly of claim 7 wherein the positioning of said lounge member is facilitated by drive means selected from electrical, hydraulic and pneumatic drive means.

10. The seat assembly of claim 7 wherein said first and second seat back rest face in opposite directions and in a back to back relation.

11. The seat assembly of claim 7 wherein said fixed sitting surface resides at an elevation higher than the elevation of said positionable sitting surface.

* * * * *